US005458462A

United States Patent [19]

Shao

[11] Patent Number: 5,458,462

[45] Date of Patent: Oct. 17, 1995

[54] SWIVEL MECHANISM FOR ELECTRICAL FAN

[75] Inventor: Steve Shao, Taisan Taipei, Taiwan

[73] Assignee: Accutek Products Corp., Taiwan

[21] Appl. No.: 281,041

[22] Filed: Jul. 27, 1994

[51] Int. Cl.[6] ..... F04D 24/36

[52] U.S. Cl. ..... 416/100; 416/244 R; 416/247 R; 74/47

[58] Field of Search ..... 416/100, 102, 416/108, 110, 170 R, 244 R, 247 R, 98; 74/47

[56] References Cited

FOREIGN PATENT DOCUMENTS

| | | | |
|---|---|---|---|
| 0081496 | 5/1985 | Japan | 416/100 |
| 0203475 | 9/1923 | United Kingdom | 416/100 |
| 0301576 | 12/1928 | United Kingdom | 416/100 |

*Primary Examiner*—Edward K. Look
*Assistant Examiner*—Christopher Verdier
*Attorney, Agent, or Firm*—Lowe, Price, LeBlanc & Becker

[57] ABSTRACT

A swivel mechanism for the electrical fan having the motor used to drive the blade of the electrical fan is used to control the swiveling movement. The controlling elements generally includes an U-shape supporting bracket, a positioning post and a connecting mechanism which is disposed between the output shaft and the positioning post. The motor is supported by an U-shape supporting bracket and the U-shape supporting bracket includes a pair of legs which can be connected to the rear housing by a pair of screws. Accordingly, the motor is capable of pitching upward and downward by the help of the screws. The lower end of the U-shape supporting bracket is rotatably mounted onto a positioning post, accordingly, the supporting bracket being capable of swiveling thereof.

2 Claims, 10 Drawing Sheets

FIG.5B
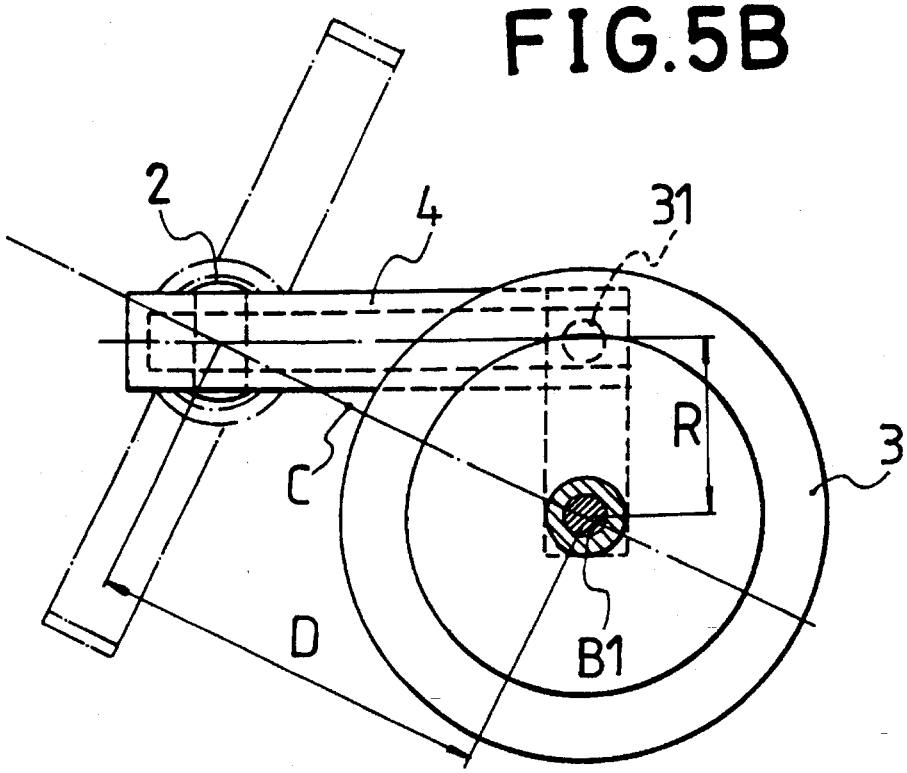
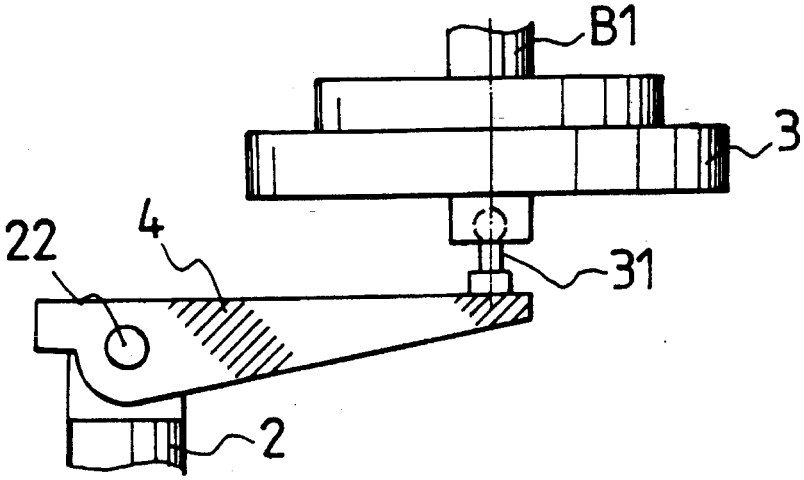
FIG.5A

FIG.5D
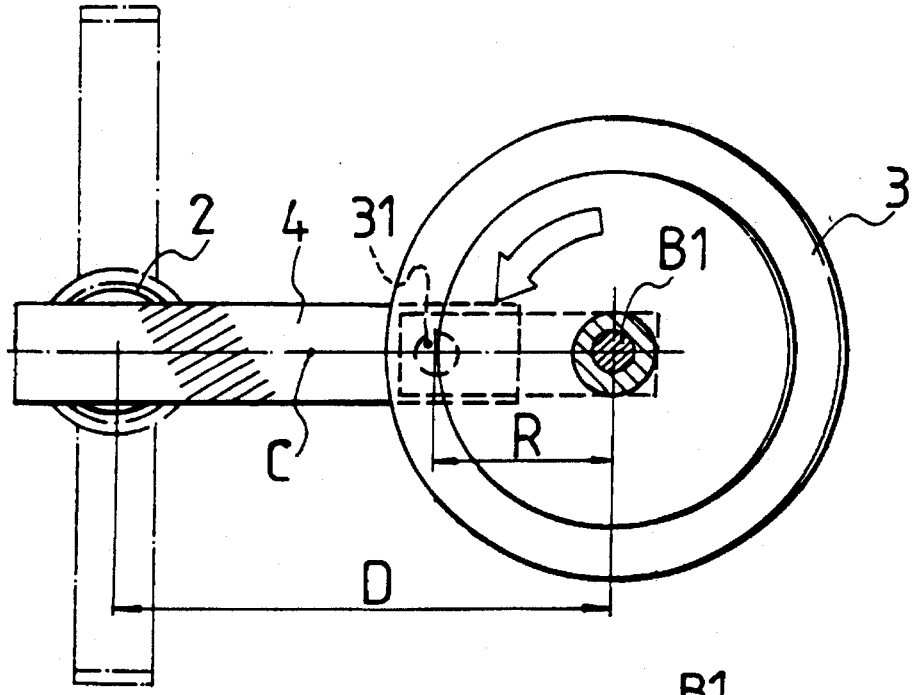
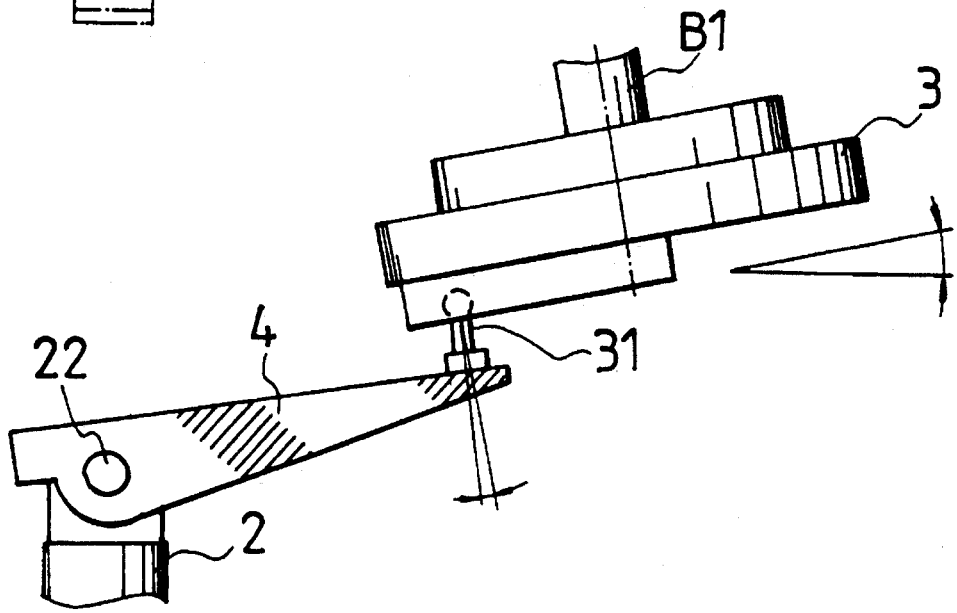
FIG.5C

SWIVEL MECHANISM FOR ELECTRICAL FAN

BACKGROUND OF THE INVENTION

This invention relates to a swivel mechanism, and more particularly, to a swivel mechanism for an electrical fan. The rear housing of the motor of the electrical fan is mounted on an U-shaped supporting bracket. The swivel gear of the electrical fan is interconnected with the positioning post which is mounted at the lower portion of the U-shape supporting bracket by means of a output shaft. Accordingly, the rotation of the gear box of the electrical fan can be used to make the electrical fan to pitch upward and downward.

At present, the conventional electrical fan, especially the standing fan, has incorporated a swivel mechanism to enlarge its swiveling angle. For example, a gearbox is incorporated with the output of the motor and translates the high resolutions of the motor into a slower rotations, while the electrical fan is swiveled periodically. On the other hand, some electrical fans are incorporated with a synchronous motor to control the swiveling motion of the electrical fan individually. But many electrical fans use the gearbox as its swivel mechanism.

But, despite which swivel mechanism is incorporated, the swiveling motion is limited to a planar direction, i.e. reciprocating moves from one point to another point. As limited by planar swiveling motion of the swivel mechanism, the wind flow generated by the fan can only cover a limited area. Consequently, the ventilation and circulation of the air flow performed by the electrical fan is poor, i.e. some areas where the air flow can not reach to will suffer poor air ventilation and circulation. If the area needs ventilation and circulation performed by the pitching of the electrical fan, the conventional swivel mechanism will certainly not meet the requirement.

SUMMARY OF THE INVENTION

It is the object of this invention to provide a swivel mechanism which facilitates the electrical fan to move not only horizontally, but also to pitch upward and downward. Accordingly, the electrical fan of this invention can blow an air flow toward a wider direction and area.

BRIEF DESCRIPTION OF THE DRAWINGS

The structural and operational characteristics of the present invention and its advantages as compared to the known state of the prior art will be better understood from the following description, in conjunction with the attached drawings which show illustratively but not restrictively an example of a swivel mechanism for the electrical fan. In the drawings:

FIGS. 5A and 5B are, respectively, side and top views showing the connecting member of the swivel mechanism of this invention;

FIGS. 5C and 5D are, respectively, front and top views similar to FIGS. 5A and 5B showing the swivel mechanism of this invention in a different position;

DETAILED DESCRIPTION OF PREFERRED EMBODIMENT

Figure 1:
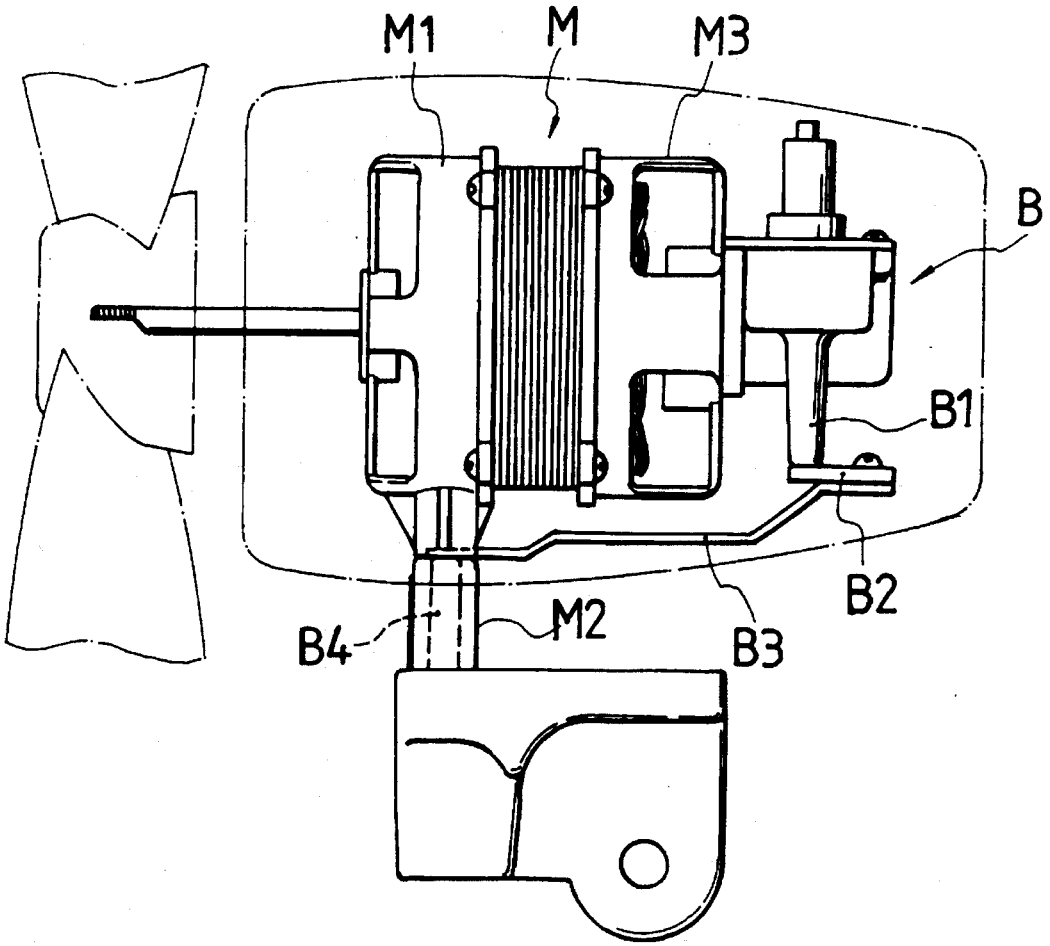
FIG.1 (PRIOR ART)
FIG. 1 is a side elevational view of a conventional electrical fan.

Referring to FIG. 1, the side elevational view of a conventional electrical fan includes a motor (M) having a frontal housing (M1) and a rear housing (M3). A supporting post (M2) is extended from the frontal housing (M1) and a gearbox (B) is mounted at the rear housing (M3). The gearbox (B) is coupled with the electrical motor (M) and the high rotations of the motor (M) is reduced to a low speed. The gearbox (M) will then provide an output through its output shaft (B1). A rocker arm (B2) is interconnected to the lower end of the output shaft (B1). The other end of the rocker arm (B2) is interconnected with another connecting rod (B3). And last, the other end of the connecting rod (B3) is interconnected to the guiding post (B4) of the motor supporting post (M2).

By this arrangement, a four parallelogram mechanism is achieved. The movement of this parallelogram mechanism is clearly shown in FIGS. 2A–C. In fact, the supporting post (M2) and the guiding post (B4) is in a standstill position. When the rocker arm (B2) is rotated by the output (B1) of the gearbox, the rest of the parallelogram mechanism will be moved accordingly, as a result, the electrical fan is moved reciprocally within a predetermined area.

Figure 2A:
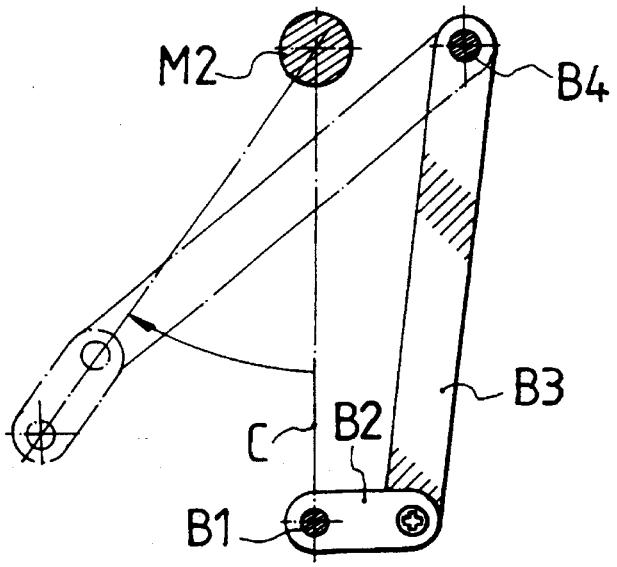
FIGS. 2A, 2B and 2C are the sketch views showing the planar movement of the electrical fan.
Figure 2B:
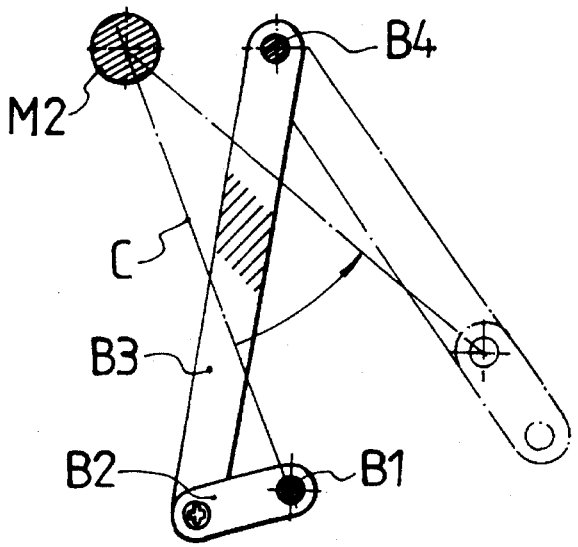
Figure 2C:
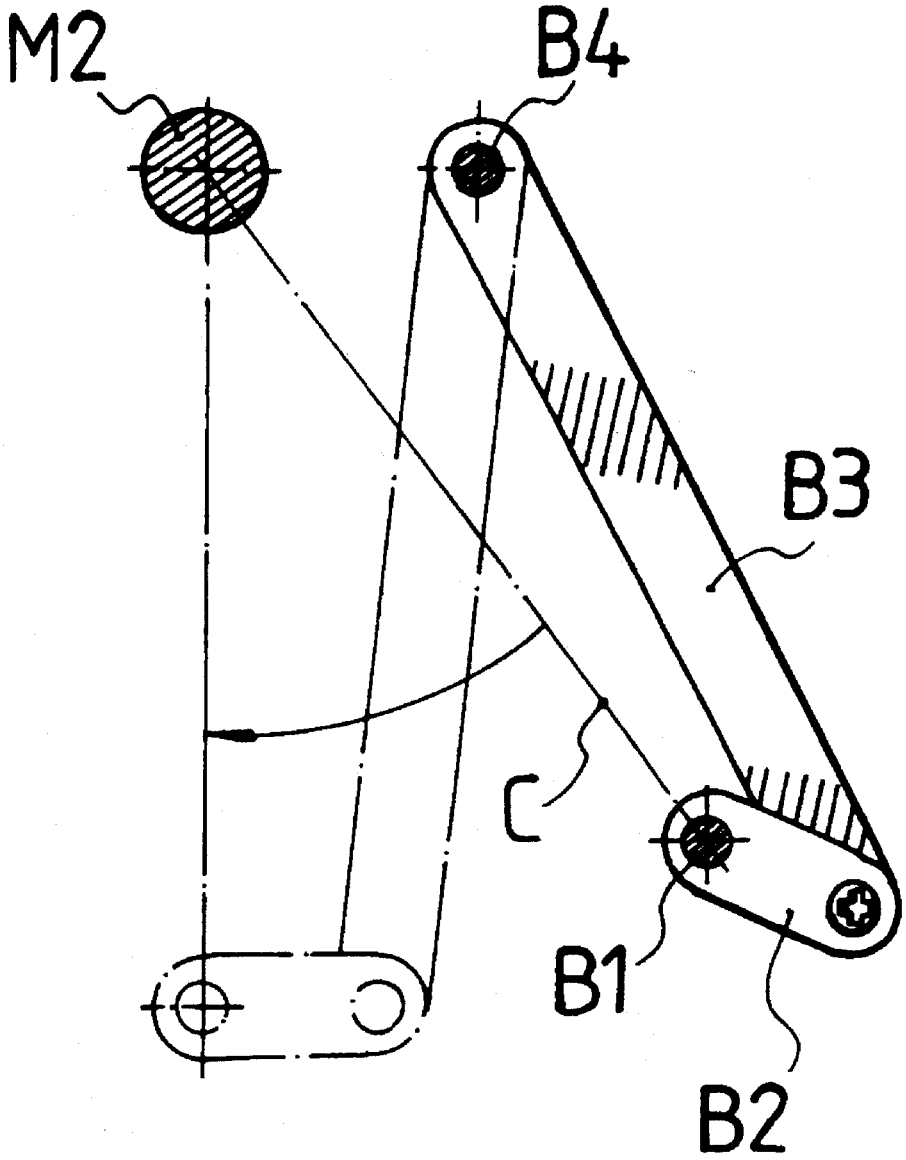

Now taking the solid line in FIGS. 2A–C as the starting point, when the rocker arm (B2) moves to the dotted line, the central line (C) which represents the electrical fan will move the left side of the supporting post (M2). In this case, the air flow blown by the electrical fan is directed to the right direction. FIGS. 2B, 2C disclose the subsequent movement. From the solid line to dotted line, we can conclude if the output shaft (B1) keeps on rotating, the recycling of the parallelogram mechanism will repeat within a certain scope. Then, the electrical fan will move periodically and reciprocally. As a result, only a planar air flow can be gained. The electrical fan can not provide an upward and downward air flow.

Figure 3:
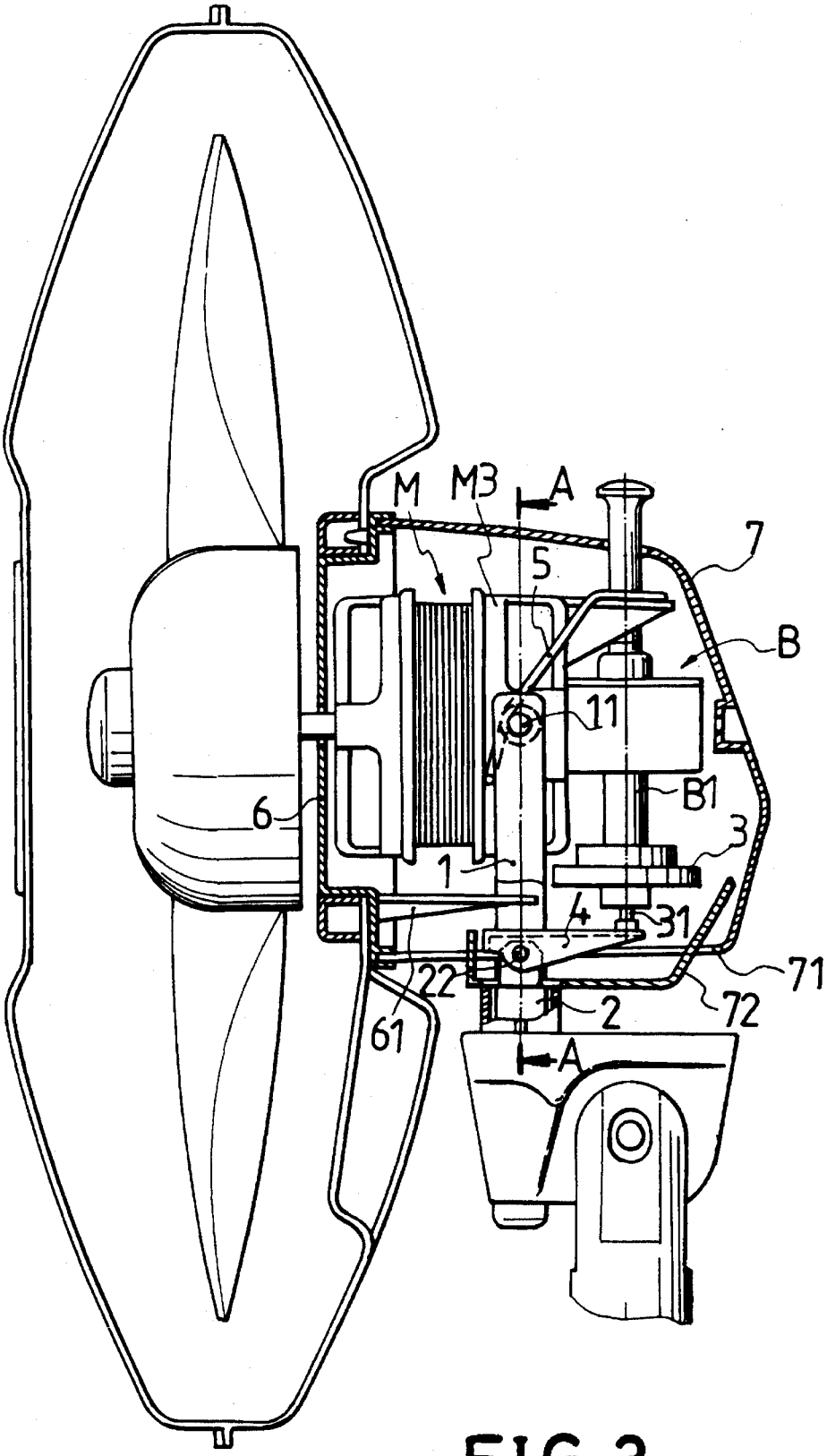
FIG. 3 is a side elevational view of the swiveling mechanism of an electrical fan.
Figure 4:
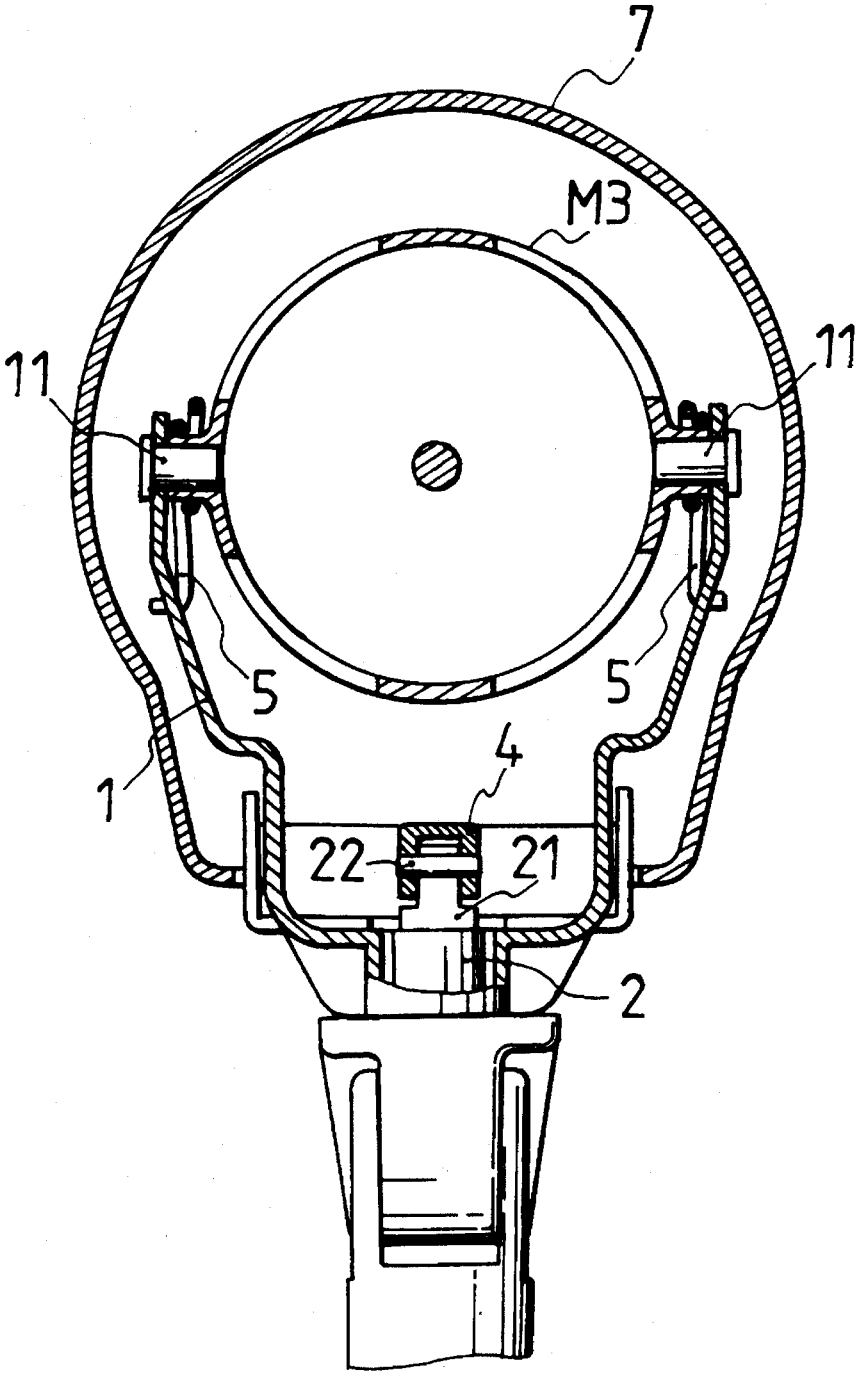
FIG. 4 is a cross sectional view taken from line A—A in FIG. 3.

Referring to FIG. 3, there is shown an embodiment of the swivel mechanism made according to this invention. The difference between the configuration of the electrical fan of this invention and the conventional electrical fan resides on the supporting mechanism for the motor (M), the connecting rod attached at the lower end of the output shaft (B1) of the gearbox (B). In the present invention, the motor (M) is supported by an supporting bracket (1). Referring to FIG. 4, the supporting bracket (1) includes a pair of legs which can be connected to the rear housing (M3) by a pair of screws (11). By this arrangement, the motor (M) (the electrical fan) can pitch upward and downward by the help of the screws (11). The lower end of the supporting bracket (1) is rotatably mounted onto a positioning post (2). Accordingly, the supporting bracket (1) can swivel thereof. The lower end of the output shaft (B1) of the gearbox (B) is coupled with a rotating member (3). The rotating member (3) is coupled with a swiveling member (4) at a suitable position radially.

Accordingly, the other end of the swiveling member (4) is also coupled to the positioning post (2) in a horizontal manner. As described, the rotating member (3) can be made in a disk or a sector configuration and the swiveling member (4) bridge rod with a suitable cross section. Accordingly, the swiveling member (4) is coupled with the T shape (21) of the positioning post (2) by means of a pin (22) horizontally. By this arrangement, the rotating member (3) is driven by the output shaft (B1) of the gearbox (B). Consequently, the swiveling member (4) is also driven. Because the positioning post (2) is in a standstill position, the relevant member will be driven to move in the designated direction. As a result, the electrical fan is pitched upward and downward.

The above described movement can be better described with FIG. 3. As shown in FIG. 3, the central line of the electrical fan is in line with the direction of the air flow blown by the electrical fan, but the electrical fan is swiveled in one direction. FIG. 3 can not disclose the swivel angle of the electrical fan. Now referring to FIGS. 5A and 5B, the planar view and top view of an enlarged view for the coupling mechanism. In fact, the positioning post (2) is in a standstill position and the horizontally coupled swiveling member (4) is then pitched upward and downward. Then the distance (D) between the rotating center of the rotating member (3) (i.e. the output shaft (B1) and the positioning post (2) is determined by the radius (R) of the rotating member (3) and the length of the swiveling member (4). That is to say, when the rotating member (3) rotates, the pivoting portion (31) of the swivel member (4) forms a circular variation. As a result, the distance (D) between two centers will increase and decrease accordingly. Consequently, the central line (C) which represents the electrical fan generates a directional change. The change of the central line (C) represents the swiveling (left and right) of the electrical fan and the change of the distance (D) between the two centers determines the pitching movement of the electrical fan. As clearly shown in FIG. 5A, the pivoting portion (31) and the output shaft (B1) is perpendicular to the swiveling member (4). In this case, an angle is formed between the central line (C) and the direction of the rotating member (4). This means that the electrical fan is swiveled to one side.

Figure 6:
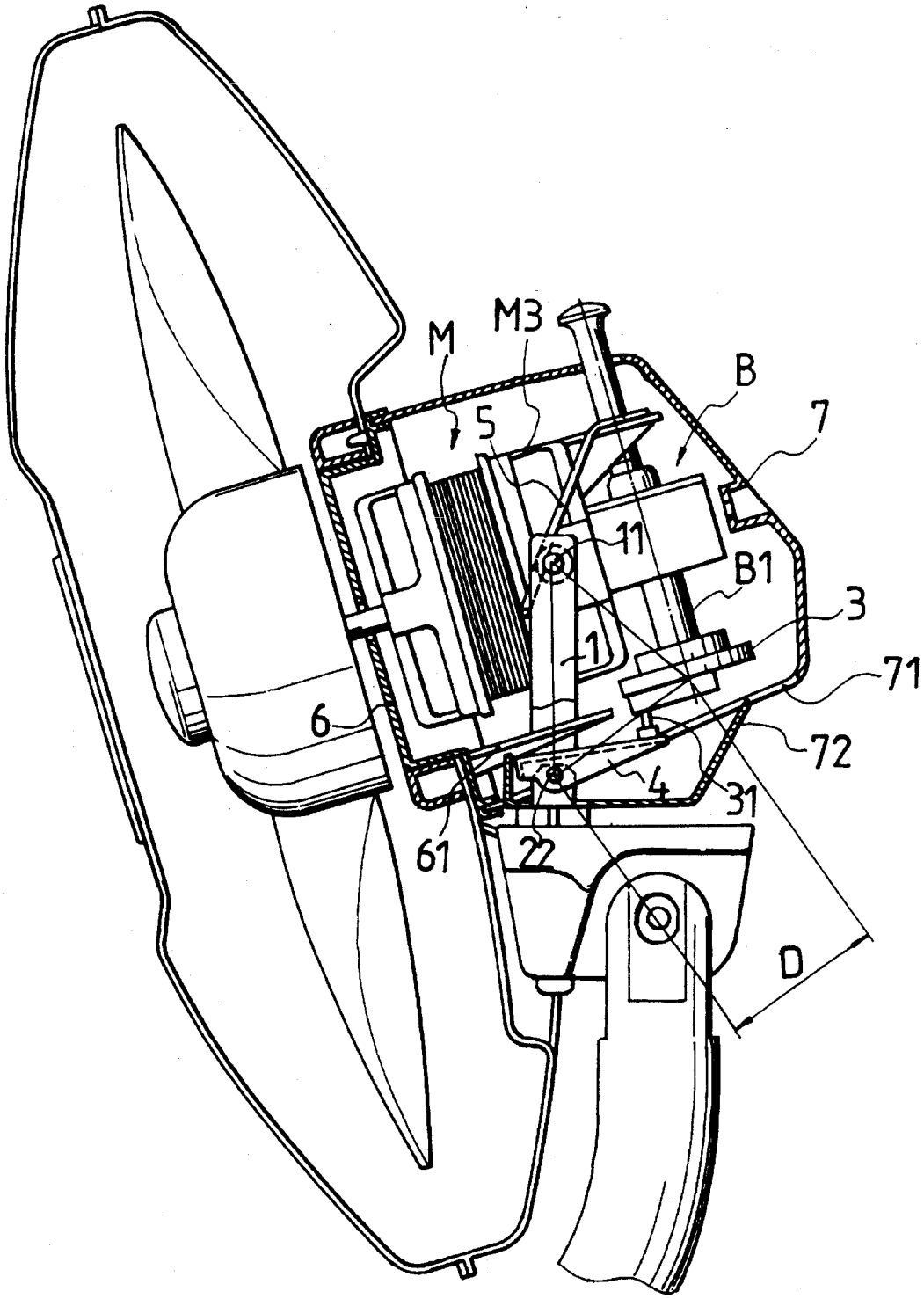
FIG. 6 is a sketch view showing the electrical fan in the downward position.

In the frontal view, the distance (D) between two centers makes the swiveling member (4) rest in a horizontal angle. This means the electrical fan is in a horizontal position. If the rotating member (3) rotates counterclockwise to ninety (90) degrees, as shown in FIGS. 5C and D, the pivoting portion (31), the output shaft (B1), the center of the positioning post (2) and the swiveling member (4) will in line with each other. That means, the rotation makes the output shaft (B1) moves (the swiveling member (4) in top view remains still). Then the central line (C) of the electrical fan returns to the original position. This rotating movement will also make the distance (D) between two centers increase. From the top view, the increase of the distance (D) will be absorbed by the inclination of the swiveling member (4). That means, the direction of the electrical fan is directed forward and downward as clearly shown in FIG. 6.

Figure 7:
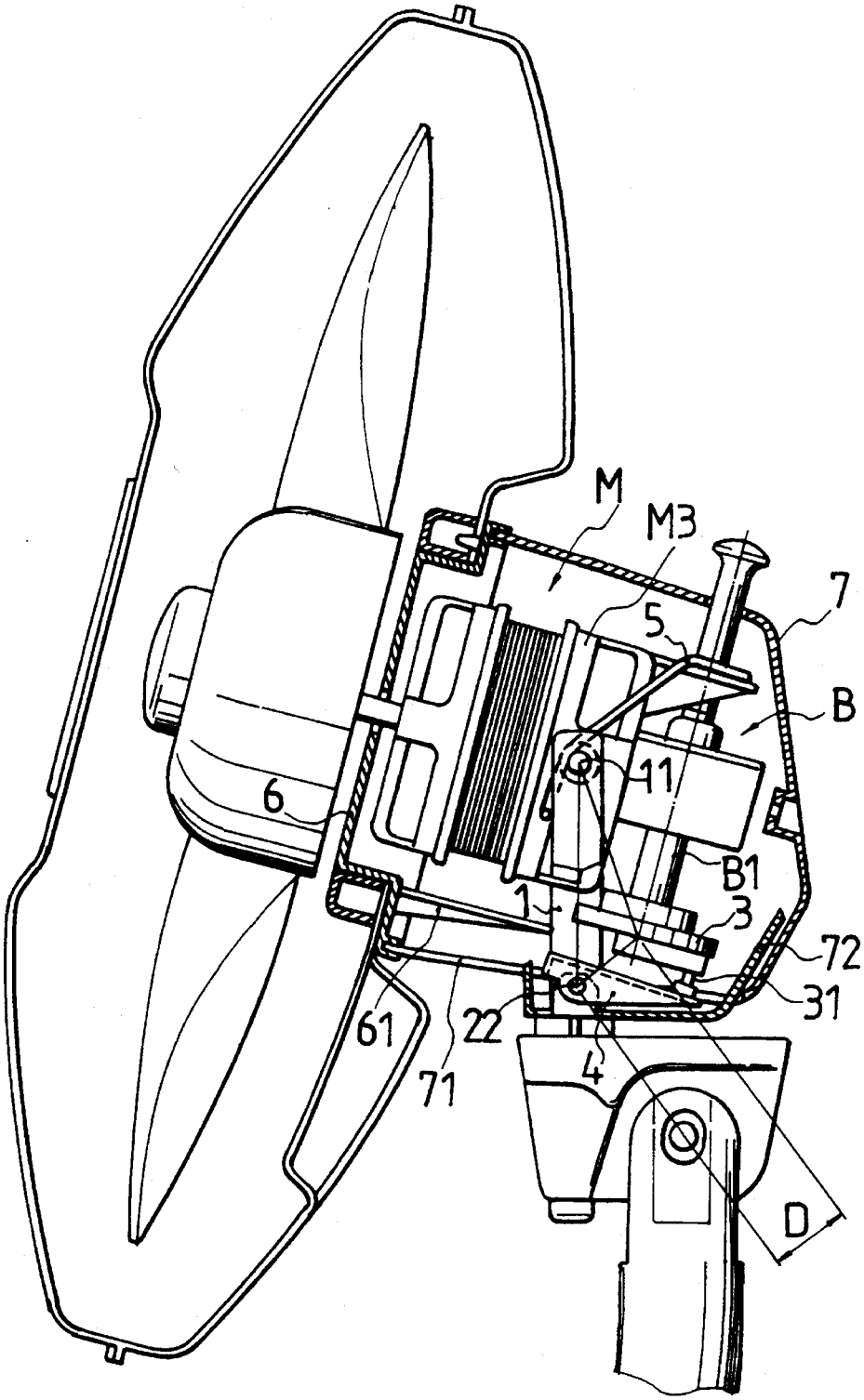
FIG. 7 is a sketch view showing the electrical fan in the upward position.

If it is viewed from the triangular area defined by the output shaft (B1), the pin (22) and the screw (11). The distance between the screw (11) to output shaft (22) and the screw (11) to the pin (22) remains unchanged. The distance from the pin (22) to the output shaft (B1) has the same function as the distance (D) between two centers. That means, this distance will be changed, increasing and decreasing, as the rotation of the rotating member (3). If the swiveling member (3) rotates through one hundred and eighty (180) degrees, as clearly shown in FIG. 7, the distance (D) is shortened and the angles within this triangular area will be changed accordingly. This variation of the angles within the triangular area will be absorbed by the pivoting portion between the screw (11) and the pin (22). Accordingly, the electrical fan is pitched upward. Specially attention shall be focused on the pivoting portion, for example, the pivoting portion between the rotating member (5) and the swiveling member (4). As shown in FIG. 5A, a very small angle will be generated during the swiveling, accordingly, but by using a ball bearing at the pivoting portion (31), the angle variation generated thereof can be completely solved.

The above description made to the movement of the pitch and the swiveling respectively, but the pitch and the swiveling of the electrical fan happen simultaneously. If viewed from the frontal position, the overlapping movement can be clearly shown in FIG. 8. That means, the movement will be moved according to (W1), (W2), (W3) and (W4) direction.

Figure 8:
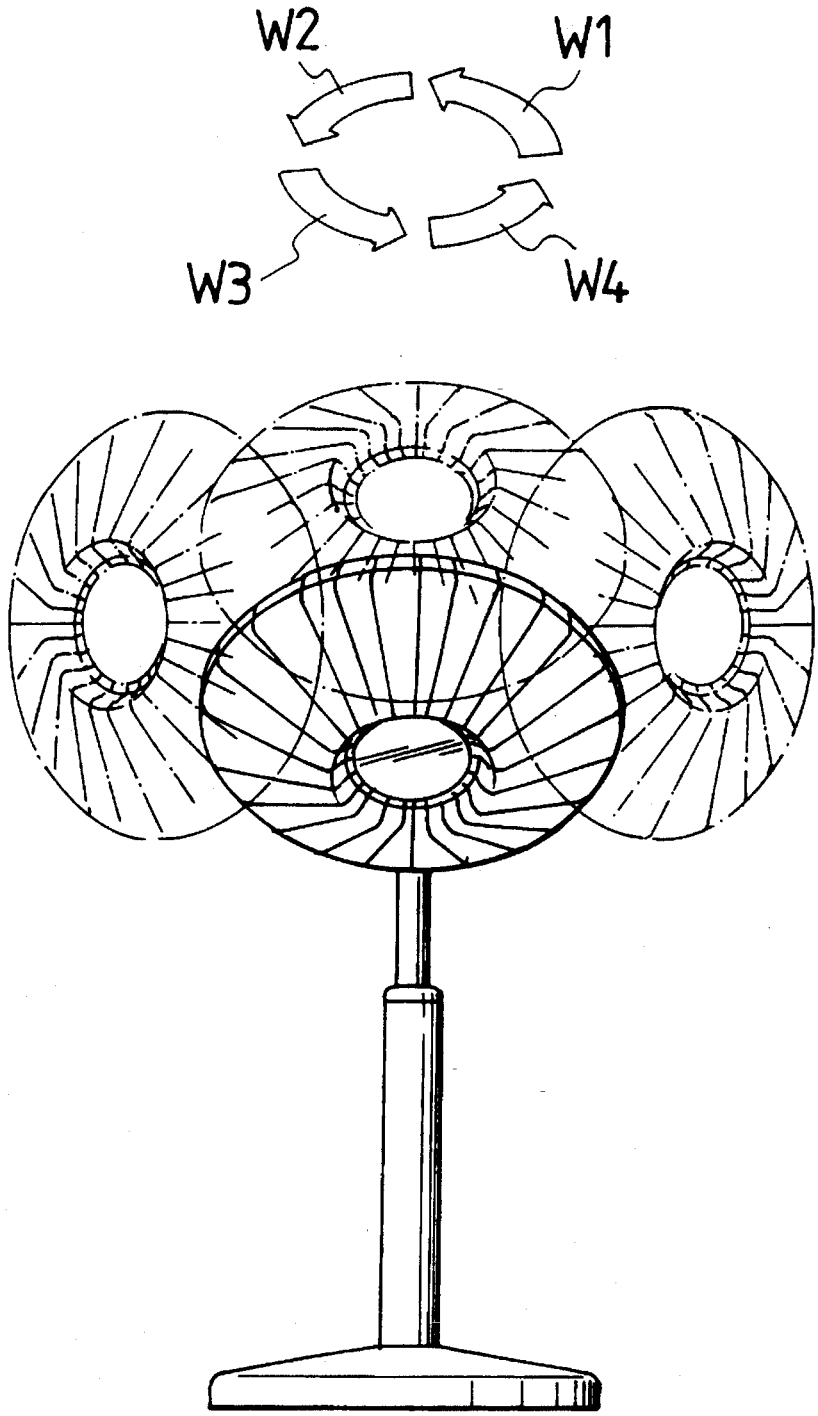
FIG. 8 is a frontal sketch view showing the movement of the electrical fan.

In considering the pitch of the electrical fan, the weight of the electrical fan together with the rear housing (M3) which is supported by the supporting bracket (1) will make the electrical fan tend to pitch downward, as clearly shown in FIGS. 3 and 4. The weight will bring a negative effect to the pitch of the electrical fan. As shown in FIG. 8, the strokes (W2) and (W3) are faster than the strokes (W1) and (W4). In the preferred embodiment, a rated spring (5) is mounted between the supporting bracket (1) and the motor rear housing (M3). The incorporated rated spring (5) will make the electrical fan pitch upward easily. The rating of the spring is preferably equivalent to the weight. By this arrangement, the pitch of the electrical fan will become smoother.

The electrical fan is covered by the rear housing (6) and the frontal housing (7) at the motor (M) to prevent the accidental touch by the hand of the user. The underside of the rear housing (7) shall be specially designed for easy extension of the positioning post (2) and the relevant conducting wires. Accordingly, a cutout (71) shall be provided accordingly. The size of the cutout (71) shall be specially designed to prevent any interference with the relevant configuration during the pitching movement. Hence, when the electrical fan is pitched both upward and downward, the cutout (71) will be exposed. In order to cover the cutout (71), a rear barrier (72) having a curve configuration is mounted at the positioning post (2) and a frontal barrier (61) is mounted at the frontal housing (6). By this arrangement, even when the electrical fan is pitched in the uppermost and lowest position, the cutout (71) is properly covered by the rear barrier (72) and the frontal barrier (61).

Although the present invention has been described in connection with the preferred embodiments thereof, many other variations and modifications will now become apparent to those skilled in the art without departing from the scope of the invention. It is preferred, therefore, that the present invention not be limited by the specific disclosure herein, but only by the appended claims.

What is claimed is:

1. A swivel mechanism for an electrical fan, having a motor and blade, the motor being used to drive the blade and control means including a supporting bracket, a positioning post and a connecting mechanism, a gear box and an output shaft therefor, the connecting mechanism being disposed between the output shaft and the positioning post;

said motor having a frontal housing and a rear housing supported by said supporting bracket, said bracket including a pair of legs connected to the rear housing of said motor by a pair of screws, the lower end of the supporting bracket being rotatably mounted on the positioning post;

said connecting mechanism comprising a rotating member and a swiveling member coupled to the output shaft of the gearbox, one end of said swiveling member being interconnected to the upper end of said positioning post horizontally and the other end of the swiveling member being radially connected to said rotating member, the connection between an end of the swiveling member and said rotating member in the radial direction being a ball bearing, and a rated spring member disposed between the supporting bracket and said motor for serving as a counter weight to the weight of the electrical fan to ensure smooth pitching movement.

2. The swiveling mechanism of claim 1, wherein the electrical fan motor rear housing and frontal housing comprise a cutout dimensioned to prevent interference with the pitching movement thereof, a rear barrier having a curved configuration mounted on the positioning post and a frontal barrier mounted on the frontal housing, whereby when the electrical fan is pitched at the uppermost and the lowest positions, the cutout will be covered by the rear barrier and the frontal barrier, respectively.

* * * * *